United States Patent [19]

Mallen-Herrero et al.

[11] Patent Number: 4,561,831

[45] Date of Patent: Dec. 31, 1985

[54] ROTARY HYDRAULIC AXIALLY SLIDABLE VANE DEVICE OF VARIABLE CAPACITY

[75] Inventors: Josè Mallen-Herrero, Paris; Daniel Leroy, Limay; Urs Zimmermann, Le Chesnay; Patrice Charlat, Mantes, all of France

[73] Assignee: Compagnie de Construction Mecanique Sulzer, Paris, France

[21] Appl. No.: 596,814

[22] Filed: Apr. 4, 1984

Related U.S. Application Data

[63] Continuation-in-part of Ser. No. 277,316, Jun. 25, 1980, abandoned.

[51] Int. Cl.[4] ..... F03C 2/00; F04C 15/04

[52] U.S. Cl. ..... 418/28; 418/232

[58] Field of Search ..... 418/22, 28, 217, 219, 418/228-232

[56] References Cited

U.S. PATENT DOCUMENTS

| | | | |
|---|---|---|---|
| 2,368,223 | 1/1945 | Kendrick | 418/31 |
| 2,977,889 | 4/1961 | Fisk | 418/28 |
| 3,250,223 | 5/1966 | Krawacki | 418/22 |
| 4,046,493 | 9/1977 | Alund | 418/22 |

FOREIGN PATENT DOCUMENTS

| | | | |
|---|---|---|---|
| 243697 | 2/1912 | Fed. Rep. of Germany . | |
| 428964 | 5/1926 | Fed. Rep. of Germany | 418/22 |
| 1045882 | 7/1953 | France . | |
| 1498399 | 9/1967 | France . | |
| 760762 | 11/1956 | United Kingdom . | |

*Primary Examiner*—John J. Vrablik

*Attorney, Agent, or Firm*—Sheridan Neimark; Karl W. Flocks; A. Fred Starobin

[57] ABSTRACT

A rotary hydraulic device of the displacement pump type having coaxial rotor and stator and vanes axially slidable in the rotor, the stator comprising at least one bottom surface formed with a variable number of deformations having rectilinear zones suitable for the operation on the recesses by the vanes. The recesses are made in movable elements of the stator such that the depth of the recesses can be made variable thus providing a device of variable capacity. The device is applicable to brakes and dampeners, as well as to engines and pumps.

8 Claims, 3 Drawing Figures

ROTARY HYDRAULIC AXIALLY SLIDABLE VANE DEVICE OF VARIABLE CAPACITY

This application is a continuation-in-part application based on application Ser. No. 277,316 filed 6/25/80 of the present Applicants, now abandoned.

BACKGROUND OF THE INVENTION

This invention relates to a rotary hydraulic device of variable capacity.

There are known devices in which the rotor is shifted axially and is in constant engagement with a stationary part.

There are also known devices in which movable elements having an imposed path are in direct engagement with an axial motion rotor element.

Further, there are known devices in which movable bosses come to meet vanes having an imposed path or not.

Finally, there is known a device in which translatable vanes having an imposed path cooperate with means for deriving fluid.

The device according to the invention is of the type of the generation of devices developed by the Applicants as for example, in Ser. No. 201,935, filed Oct. 29, 1980, by the Applicants, comprising axially slidable vanes being disposed in alignment in rotor housings, each of said vanes being applied constantly and totally on a continuous stator bottom surface, which may be cycloidal and can be deformed to present rectilinear zones or recesses suitable for the operation of the device. The intermediary space between the rotor and stator has a circularly variable longitudinal axial interval partly defined by said continuous stator bottom surface of a constant width and which is single for a given set of vanes.

According to one of the devices of such generation of devices developed by the Applicants in the aforementioned application, the axially slidable vanes are arranged in pairs in rotor housings on either side of a central stator part, the recesses being opposed to one another back-to-back on either side of said central stator part and made thereon, and the vanes coming closer to one another to be applied to the continuous bottom surfaces having recesses therein of said stator part biased against these surfaces by spring or other means.

According to another device from said generation of devices, a central stator part, having bottom surfaces provided on either side of a symmetrical axis, is made integrally with a stationary shaft portion and the rotor is mounted as a cage about the stator.

SUMMARY OF THE INVENTION

The object of this invention is a variable capacity rotary hydraulic device of the displacement pump type having coaxial rotor and stator and axially slidable vanes in the rotor, the stator comprising at least one bottom surface having a variable number of deformations having recesses or rectilinear zones suitable for the operation on the recesses by said vanes coming to bear on said bottom surface, wherein said recesses are made in movable elements of the stator such that the depth thereof can be made variable thus providing a device of variable capacity.

There is provided control means for acting, as desired, in the stopping position and/or during the operation upon said movable stator elements having recesses and therefore also upon the depth of said recesses, with said movable stator elements being movable in the stator housings.

The stator comprises ramps on the one hand and on the other, movable stator elements with recesses therein, the ramps and recesses successively affording constant contact with all or part of the forward nose portion of each slidable vane.

BRIEF DESCRIPTION OF THE DRAWINGS

Other characteristics and advantages of this invention will appear from the following exemplifying description with reference to the attached drawings, in which.

DESCRIPTION OF THE PREFERRED EMBODIMENT

Figure 1:
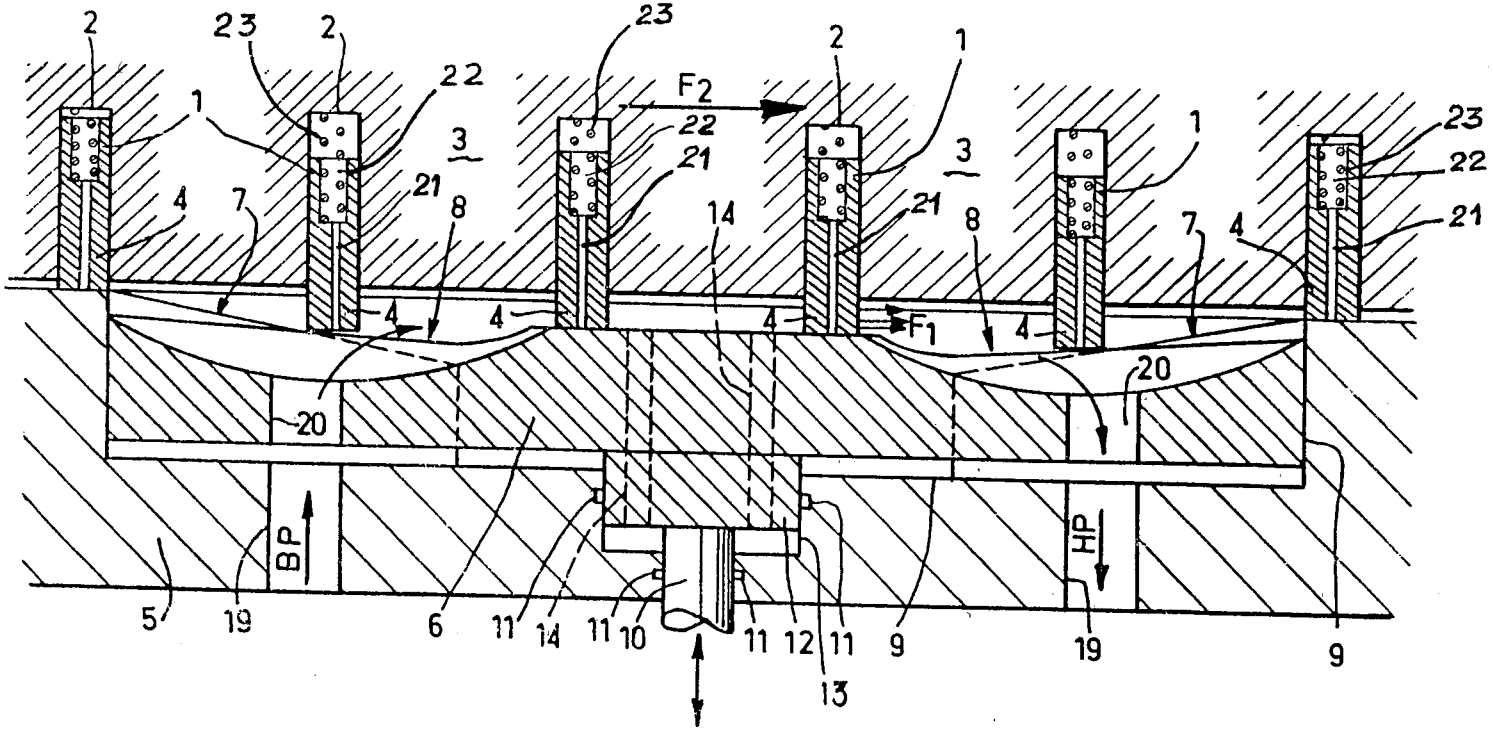
FIG. 1 is a schematic expanded view of a portion of a rotary hydraulic device according to the invention.

In the form of embodiment shown, axially slidable vanes 1 shown freely sliding in housings 2 formed in a rotor 3 come to bear by at least one edge portion of their nose 4 projecting therefrom, on a bottom stator surface having deformations or recesses therein. This continuous stator surface has the distinguishing feature of being composite, in that it comprises both a stationary portion 5 and movable portions or elements 6. The stationary portion 5 comprises ramps 7 and movable elements 6 comprise recesses 8 therein.

The movable elements 6 can move in housings 9 formed in the stationary stator portion, in the stopping position and/or during the operation, under the action of a mechanical, hydraulic or magnetic outer control means 10. Sealing means 11 are provided between a hub 12 and the control 10 of each movable element 6 and guideway 13 in the respective stator housing. Channels 14 for hydraulic balance pass through each movable element 6.

Figure 2:
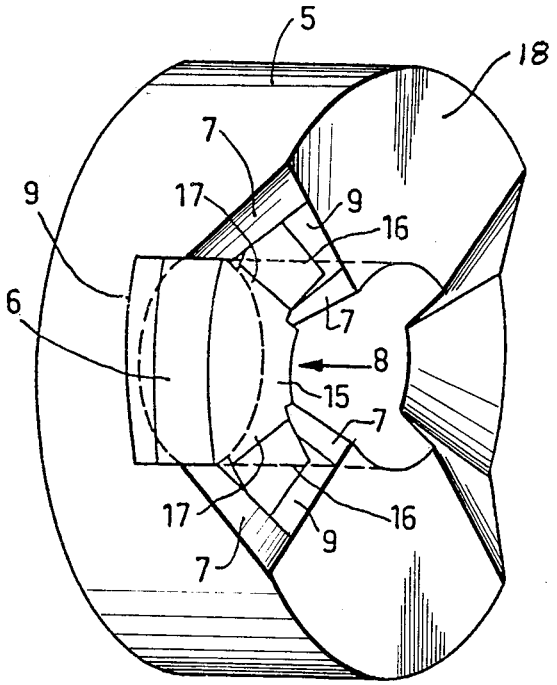
FIG. 2 is a perspective view of the stator of a device according to the invention comprising at least one movable recessed stator element.
Figure 3:
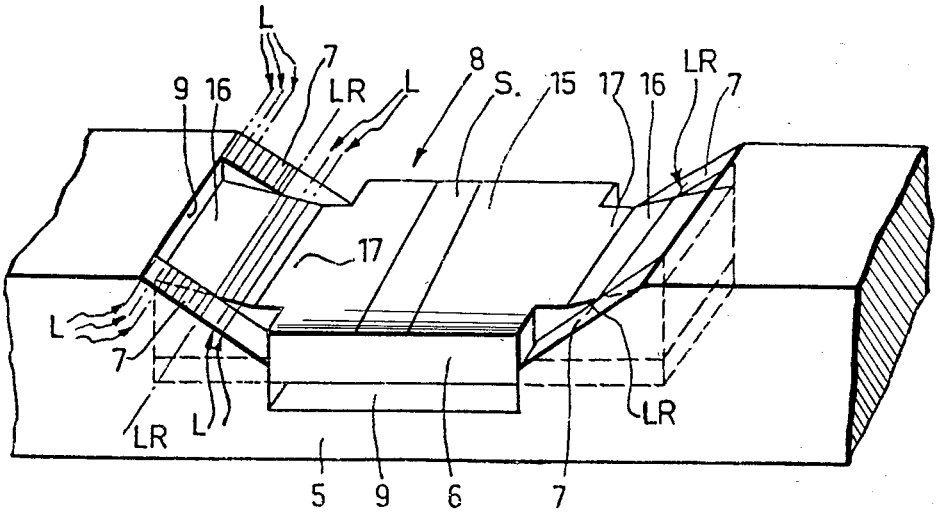
FIG. 3 is a perspective view of a stator portion, showing one movable recessed stator element and relieving stator ramps.

In the form of embodiment shown in FIGS. 2 and 3, each movable element 6 having a recess 8 therein is formed with a central flat portion 15 constituting the bottom of the recess and on either side of this central flat portion, a wing 16 having a raised slope with respect to the central flat portion.

Each wing 16 is laterally restricted with respect to the width of the central flat portion 15 so that it can be inserted in the stator housing 9 between two stationary stator ramps 7 of the stationary porton 5 of the stator. A planar zone 17 also laterally restricted can provide a connection between the central flat portion 15 and each wing 16.

Both ramps 7 functionally relieve with the more or less enclosed wing 16 to ensure proper constant contact of all or part of the forward nose of the respective vane 1 (or at least of all or part of an edge portion of said nose) with the stator, when the vane 1 moves past, from the stationary stator portion 5, the enclosed sloping wing 16 to reach the restricted portion 17 and the central flat portion 15. The constant engagement of said parts is made, sometimes by means of an edge portion, sometimes by other means, with intermediary passage on a flat portion in the form of embodiment shown in FIGS. 2 and 3, in which each vane having an exemplifying form with a forward quadrangular nose which operates against the movable stator portion 6 which has two recesses 8 therein separated by a planar zone 18.

With reference to FIG. 3, virtual lines L symbolically show mutual contact of the stator bottom surface with a vane having a forward quadrangular nose, between an edge portion of said nose and both stationary stator ramps 7, on the one hand, and then, on the other hand, between the same edge portion and a portion of the sloping wing 16 more or less enclosed, depending on the position of the movable stator element 6 in the stator housing 9. It may be noted that there is a relieving contacting line LR, commonly shared by both stator ramps 7 and the enclosed sloping wing 16. Both on the planar zone 18 and the restricted zone 17 and the central flat portion 15, the contact is no longer linear, but is rather made according to a surface S corresponding to the quadrangular forward nose surface of the vane.

According to a working variation schematically shown on FIG. 1, low pressure BP and high pressure HP circuits pass through the stator, both in its stationary portion 5, by means of channels 19 therein and in its movable portion 6 by channels 20 therein, with the action of a vane 1 upon a fluid being shown by arrows F1 and the rotor motive power by means of arrow F2. In the active compression zone, the vanes, freely sliding in their housings 2, are perfectly engaged with the stator bottom surface during the relative movement of vanes 1 and stator surface. Each vane 1 is bored with a hydraulic equalizing duct 21, and with a hole 22 within which is placed a biasing spring 23. Biasing spring 23 abuts with one of its ends against the bottom of hole 22 and with its other end against the bottom of housing 2 containing vane 1. Thus vanes 1 are pressed against stator surfaces and freely slidable against the bias when acted on by the stator surface.

Proper sealing means are provided on the lateral sides of the vanes.

It will be understood that this invention is only described and represented in preferential exemplifying forms of embodiment and that equivalent parts may be substituted for its constitutive elements without, however, departing from its scope which is defined in the appended claims.

We claim:

1. A rotary hydraulic device of variable capacity with coaxial stator and rotor, the stator comprising at least one circumferentially continuous generally transversal bottom surface with at least one axially recessed portion and the rotor being provided with vanes axially freely slidable therein and biased so as to bear constantly on said continuous bottom surface while circumferentially sliding thereon, said stator comprising a stationary element and a movable element axially slidable therein, said recessed portion being made in said movable element such that the depth thereof can be varied thus providing a device of variable capacity, circumferentially orientated ramp means being provided on said stationary and movable elements respectively thus providing said continuous stator bottom surface with variable composite transition zones between the stationary element and a median portion of the movable element.

2. A rotary hydraulic device as claimed in claim 1 comprising control means for acting upon said movable stator elements having recesses therein and thus upon the depth of said recesses, and stator housings, said movable stator elements being movable in said stator housings.

3. A rotary hydraulic device as claimed in claim 1, each of said movable stator elements having recesses therein formed with a central flat portion constituting the bottom of said recess and on either side of said central flat portion a wing with a raised slope with respect to said central flat portion.

4. A rotary hydraulic device as claimed in claim 1, each of said movable stator elements having recesses therein having a central flat portion constituting the bottom of said recess and on either side of said central flat portion a wing with a raised slope with respect to said central flat portion, each of said wings being laterally restricted with respect to the width of said central flat portion so as to be insertable between two of said stationary stator ramp means.

5. A rotary hydraulic device as claimed in claim 1, each of said movable stator elements having recesses therein being formed with a flat central portion constituting the bottom of said recess, and on either side of said central flat portion a wing having a raised slope with respect to said central flat portion, each of said wings being laterally restricted with respect to the width of said central flat portion so as to be insertable between two of said stationary stator ramp means, a laterally restricted zone making a connection between said central flat portion and each of said wings.

6. A rotary hydraulic device as claimed in claim 1, wherein said movable stator elements are hydraulically balanced.

7. A rotary hydraulic device as claimed in claim 1, comprising channels therein, suitable for low pressure and high pressure circuits passing through said stator and said movable elements.

8. A rotary hydraulic device as claimed in claim 1, comprising lateral sealing means for said slidable vanes.

* * * * *